US007675476B2

(12) United States Patent
Wang

(10) Patent No.: US 7,675,476 B2
(45) Date of Patent: Mar. 9, 2010

(54) INTERNAL ANTENNA WITH ROTATABLE MOUNTING BRACKET ASSEMBLY

(75) Inventor: Cheng-Si Wang, Changhua Hsien (TW)

(73) Assignee: Trans Electric Co., Ltd., Changhua Hsien (TW)

( * ) Notice: Subject to any disclaimer, the term of this patent is extended or adjusted under 35 U.S.C. 154(b) by 417 days.

(21) Appl. No.: 11/746,750

(22) Filed: May 10, 2007

(65) Prior Publication Data

US 2008/0278403 A1 Nov. 13, 2008

(51) Int. Cl.
*H01Q 3/02* (2006.01)
*H01Q 1/24* (2006.01)

(52) U.S. Cl. ..... 343/882; 343/702

(58) Field of Classification Search ..... 343/702, 343/872, 878, 882, 906
See application file for complete search history.

(56) References Cited

U.S. PATENT DOCUMENTS 3,181,163 A * 4/1965 Kozlow et al. ..... 343/702
5,828,341 A * 10/1998 Delamater ..... 343/702

* cited by examiner

*Primary Examiner*—Shih-Chao Chen
(74) *Attorney, Agent, or Firm*—Rahman LLC

(57) ABSTRACT

A internal antenna with rotatable mounting bracket assembly is mounted on an edge of a flat panel television and has a mounting bracket, a clamp and a rotatable antenna seat. The mounting bracket is mounted on the edge of a flat panel television and has a mounting disk, a front jaw and a clamp socket. The clamp attaches to and holds the mounting bracket on the edge of a flat panel television and has an arm assembly and a rear jaw. The arm assembly is mounted slidably in the clamp socket and has a resilient element. The resilient element holds the clamp in the clamp socket. The rear jaw is formed on and protrudes down from the arm assembly. The rotatable antenna seat is mounted rotatably on the mounting bracket and has an antenna bracket. The antenna bracket clips the antenna and is formed on the disk.

18 Claims, 7 Drawing Sheets

INTERNAL ANTENNA WITH ROTATABLE MOUNTING BRACKET ASSEMBLY

BACKGROUND OF THE INVENTION

1. Field of Invention

The present invention relates to an antenna, and more particularly to an internal antenna with rotatable mounting bracket assembly for a flat panel television.

2. Description of the Related Art

Flat panel televisions have become more and more popular. An internal antenna is used to receive broadcast signals. Conventional internal antennas used with flat panel televisions cannot be rotated easily to adjust reception of the antenna after the antenna has been mounted on the flat panel television. When the signal becomes weak, the internal antenna must be moved or completely reinstalled.

To overcome the shortcomings, the present invention provides an internal antenna with rotatable mounting bracket assembly.

SUMMARY OF THE INVENTION

The primary objective of the present invention is to provide an internal antenna with rotatable mounting bracket assembly to allow the antenna to be easily adjusted for optimum reception.

The internal antenna with rotatable mounting bracket assembly in accordance with the present invention is mounted on an edge of a flat panel television and comprises a mounting bracket, a clamp, a rotatable antenna seat and an antenna. The mounting bracket is mounted on the edge of a flat panel television and has a mounting disk, a front jaw and a clamp socket. The clamp attaches to and holds the mounting bracket on the edge of a flat panel television and has an arm assembly and a rear jaw. The arm assembly is mounted slidably in the clamp socket and has a resilient element. The resilient element holds the clamp in the clamp socket. The rear jaw is formed on and protrudes down from the arm assembly. The rotatable antenna seat is mounted rotatably on the mounting bracket and has an antenna bracket. The antenna bracket clips the antenna and is formed on the disk.

Other objectives, advantages and novel features of the invention will become more apparent from the following detailed description when taken in conjunction with the accompanying drawings.

DETAILED DESCRIPTION OF THE INVENTION

Figure 1:
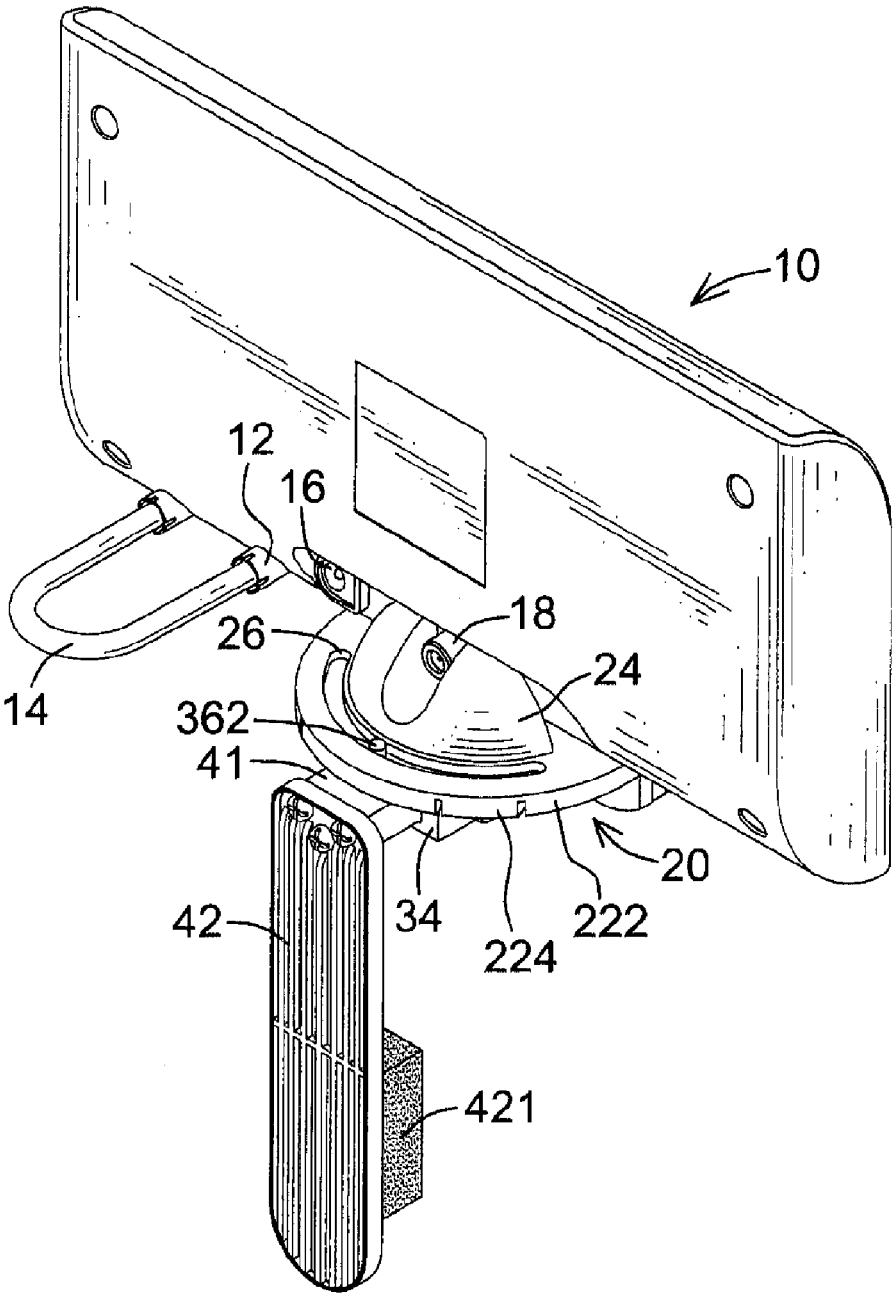
FIG. 1 is a rear perspective view of an internal antenna with rotatable mounting bracket assembly in accordance of the present invention.
Figure 2:
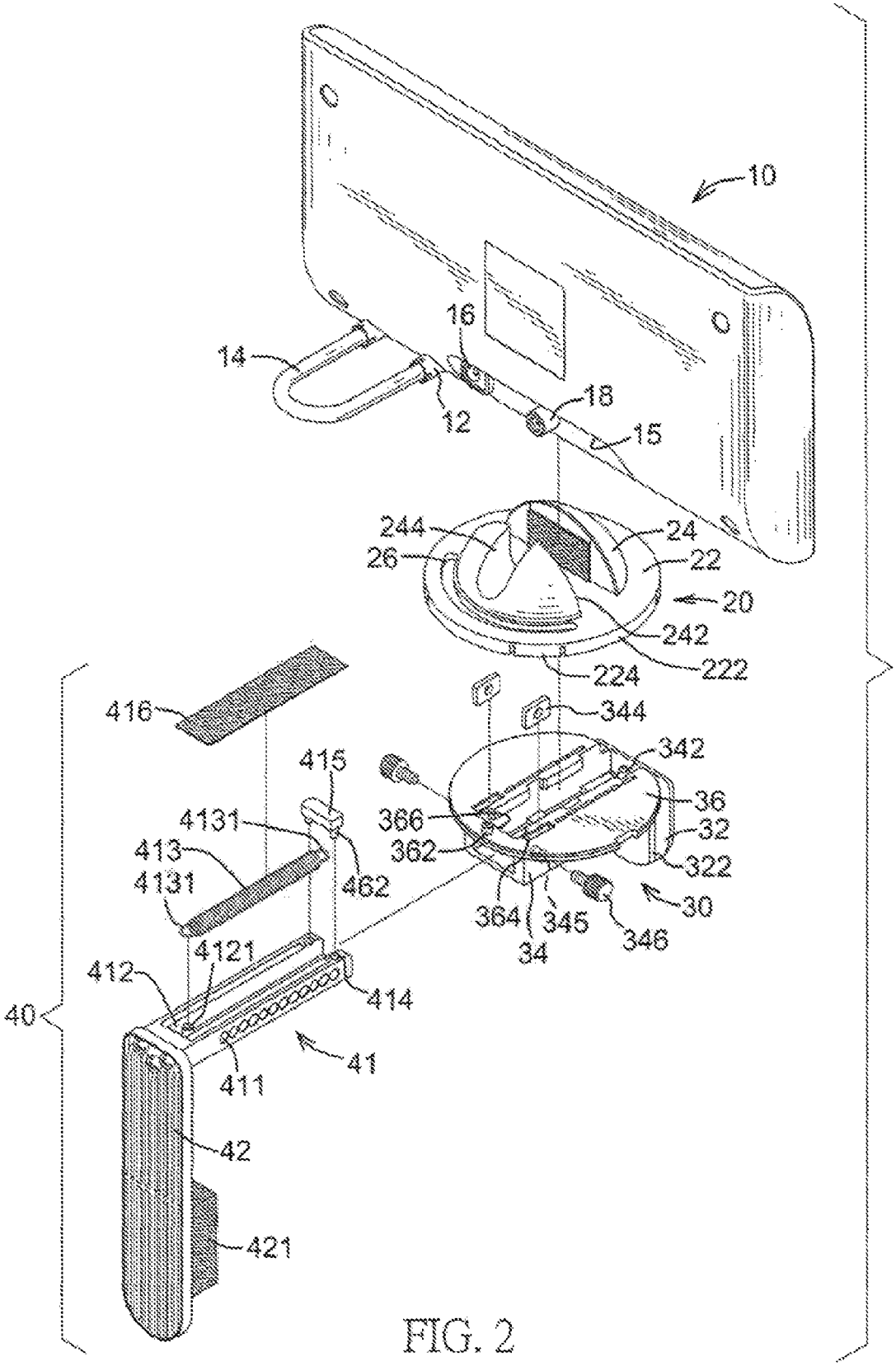
FIG. 2 is an exploded perspective view of the internal antenna with rotatable mounting bracket assembly in FIG. 1.
Figure 4:
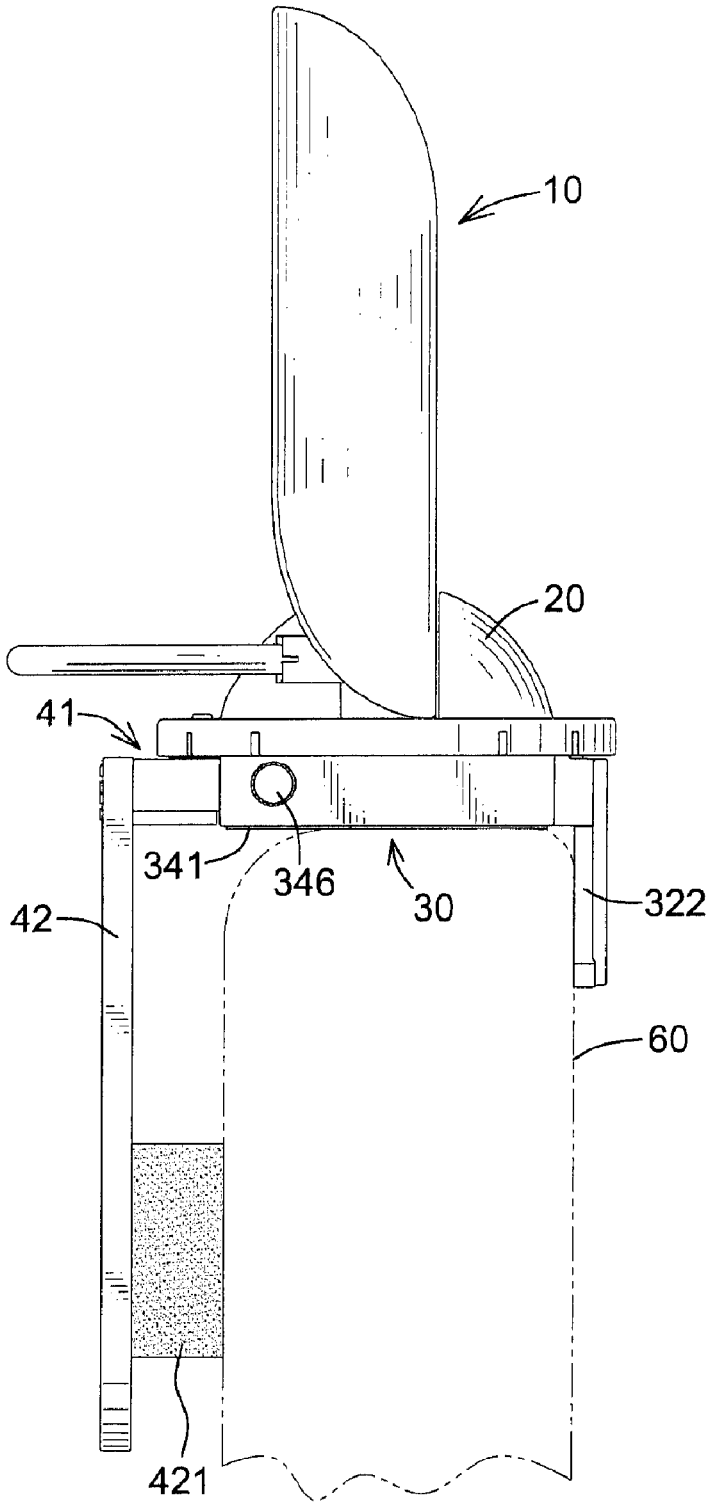
FIG. 4 is an operational right side view the internal antenna with rotatable mounting bracket assembly in FIG. 1 installed on a flat panel television.

With reference to FIGS. 1, 2 and 4, an internal antenna with rotatable mounting bracket assembly in accordance with the present invention is mounted on an edge of a flat panel television (60) having a front surface and a rear surface and comprises a mounting bracket (30), a clamp (40), a rotatable antenna seat (20) and an optional antenna (10).

The mounting bracket (30) is mounted on the edge of a flat panel television (60) and has a mounting disk (36), a front jaw (32) and a clamp socket (34).

The mounting disk (36) is mounted on the edge of a flat panel television (60) and has an upper surface, a lower surface, an outer edge, an open slot, a positive stop (362), two notches (364) and a clamp stop (366). The open slot is formed diametrically through the mounting disk (36) and has a front end, a rear end and two parallel edges. The front end communicates with the outer edge. The positive stop (362) is formed on and protrudes up from the upper surface. The two notches (364) are formed respectively in the parallel edges of the open slot. The clamp stop (366) is defined at the rear end of the open slot.

The front jaw (32) may be a rectangular bar, is formed on and protrudes down perpendicular from the lower surface of the mounting disk (36) at the outer edge corresponding to the front end of the open slot, is mounted against the front surface of a flat panel television (60) and has a rear surface and an optional non-slip coating (322). The rear surface presses against the front surface of a flat panel television (60). The non-slip coating (322) is attached to and covers the rear surface of the front jaw (32).

Figure 3:
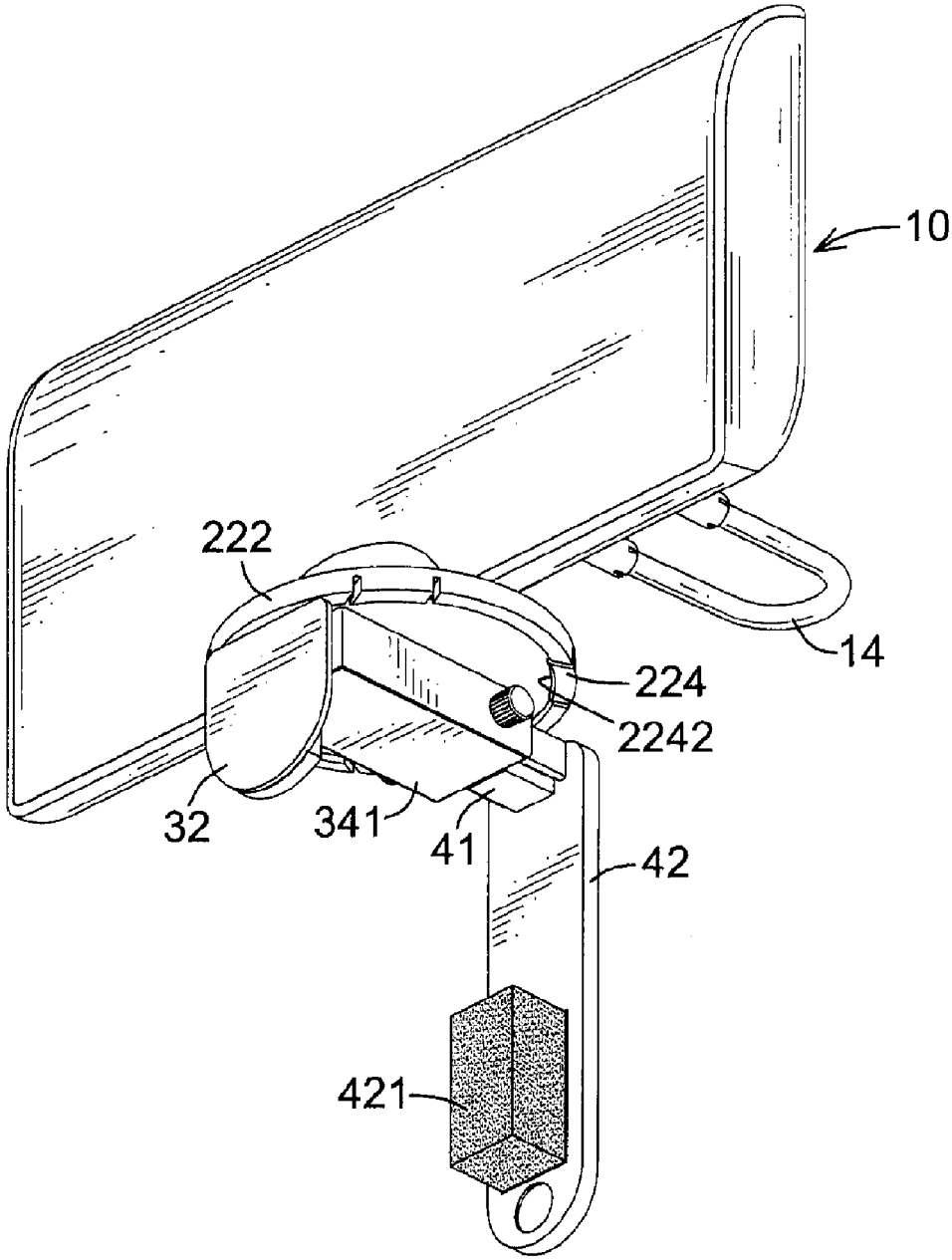
FIG. 3 is a front perspective view of the internal antenna with rotatable mounting bracket assembly in FIG. 1.

With further reference to FIG. 3, the clamp socket (34) is formed on and protrudes down from the lower surface of the mounting disk (36), is connected to the front jaw (32), corresponds to and communicates with the open slot and has an inner bottom surface, two longitudinal edges, a front end, a rear end, two sidewalls, a bottom surface, at least one tab recess, an optional protective sheet (341), a post (342), at least one setscrew tab (344), at least one setscrew hole (345) and at least one setscrew (346). The front end of the clamp socket (34) is connected to the rear surface of the front jaw (32). The at least one tab recess is formed in one of the longitudinal edges, and when the clamp socket (34) has two tab recesses, the tab recesses are formed respectively in the longitudinal edges. The protective sheet (341) may be a non-slip coating and is attached to the bottom surface of the clamp socket (34). The post (342) is formed on and protrudes up from the inner bottom surface of the clamp socket (34) near the front end. A setscrew tab (344) is mounted in each tab recess and has a hole. The at least one setscrew hole (345) is formed through a sidewall of the clamp socket (34) and corresponds to the hole in the corresponding setscrew tab (344). Each setscrew (346) is mounted rotatably through a setscrew hole (345) and adjustably through the hole in the setscrew tab (344) and has a shaft and a head. The shaft has a distal end.

The clamp (40) attaches to and holds the mounting bracket (30) on the edge of a flat panel television (60) and has an arm assembly (41) and a rear jaw (42).

The arm assembly (41) is straight, corresponds to and is mounted slidably in the clamp socket (34), protrudes from the open end of the clamp socket (34) and has a proximal end, a distal end, two sidewalls, a top surface, multiple positioning holes (411), a longitudinal slot (412), a resilient element (413), two optional retainer holes (414), an optional retainer (415) and an optional cover (416).

Multiple positioning holes (411) are formed in a line through each sidewall of the arm assembly (40), correspond respectively to positioning holes (411) in the opposite sidewall and holds the distal end of the setscrew (346) mounted through the setscrew hole (345) in the clamp socket (34) and the hole in the corresponding setscrew tab (344) to hold the arm assembly (41) and the clamp (40) securely in place.

The longitudinal slot (412) is formed longitudinally in the top surface of the arm assembly (40), forms an opening in the distal end of the arm assembly (40) and has a bottom surface and a post (4121). The post (4121) is formed on and protrudes up from the bottom surface close to the proximal end of the arm assembly (40).

The resilient element (413) may be a spring, pulls the aim assembly (40) into the clamp socket (34) and has two ends and two rings (4131). The two rings (4131) are formed respectively on the ends of the resilient element (413) and are attached respectively to the posts (342, 4121).

The two retainer holes (414) are formed in the top surface of the arm assembly (40) near the distal end.

The retainer (415) is a bridge, is thicker than the clamp stop (366), is mounted on the top surface of the arm assembly (40) near the distal end, keeps the arm assembly (40) from sliding out of the clamp socket (34) by abutting the clamp stop (366) and has a bottom surface and two mounting posts (462). The two mounting posts (462) are formed on and protrude from the bottom surface of the retainer (415) and correspond respectively to and are plugged respectively into the retainer holes (414).

The cover (416) is rectangular and corresponds to and covers the longitudinal slot (412).

The rear jaw (42) is parallel to the front jaw (32) of the mounting bracket (30), clamps a flat panel television (60) between the rear jaw (42) and the front jaw (32) of the mounting bracket (30), may be a rectangular bar and has a proximal end, an inner surface and an optional protective pad (421). The proximal end of the rear jaw (42) is connected to and protrudes down from the proximal end of the arm assembly (40). The protective pad (421) is resilient, may be foam rubber, a polymer or the like, keeps the rear jaw (42) from marring a flat panel television (60) and is attached to the inner surface of the rear jaw (42).

The rotatable antenna seat (20) is mounted rotatably on the upper surface of the mounting disk (36) of the mounting bracket (30) and has a disk (22), an antenna bracket (24) and a curved slot (26).

The disk (22) is mounted rotatably on the top surface of the mounting disk (36) of the mounting bracket (30) and has an outer edge, a top surface, a bottom surface, multiple limiting skill segments (222) and at least one hooking skirt segment (224). The bottom surface rotatably abuts the top surface of the mounting disk (36) of the mounting bracket (30). The multiple limiting skirt segments (222) are formed on and protrude down from the bottom surface at the outer edge and prevent the disk (22) from sliding off the mounting disk (36) of the mounting bracket (30). The at least one hooking skirt segment (224) is resilient, is formed on and protrudes down from the bottom surface at the outer edge between adjacent limiting skirt segments (222) and rotatably connects the rotatable antenna seat (20) to the mounting disk (36) of the mounting bracket (30), and each hooking skirt segment (224) has a distal edge and a lip (2242). The lip (2242) is formed on and protrudes in from the distal edge and slidably engages the edge of the mounting disk (36) of the mounting bracket (30).

The antenna bracket (24) may be plastic, is formed on and protrudes up from the top surface of the disk (22) and has a rear, a groove (242) and an optional recess (244). The groove (242) is formed transversely through the antenna bracket (24). The recess (244) is formed in the rear of the antenna bracket (24) and communicates with the groove (242).

The curved slot (26) is formed through the disk (22), is mounted on the positive stop (362) on the mounting disk (36) to limit the rotation of the rotatable antenna seat (20) and has a width.

The antenna (10) may be an internal flat antenna, is mounted in the groove (242) of the antenna bracket (24) and has a front surface, a rear surface and an optional wire guide (14). The rear surface has two optional holes (12), an optional recess (15), a power socket (16) and a signal socket (18). The recess (15) is formed in the rear surface of the antenna (10) and corresponds to the transverse groove (242) in the antenna bracket (24). The power socket (16) is formed in the recess (15). The signal socket (18) is formed in the recess (15) and aligns with the recess (244) in the antenna bracket (24). The wire guide (14) is U-shaped, is mounted on and protrudes from the rear surface and has two ends. The two ends of the wire guide (14) are mounted respectively in the two holes (12).

Figure 5:
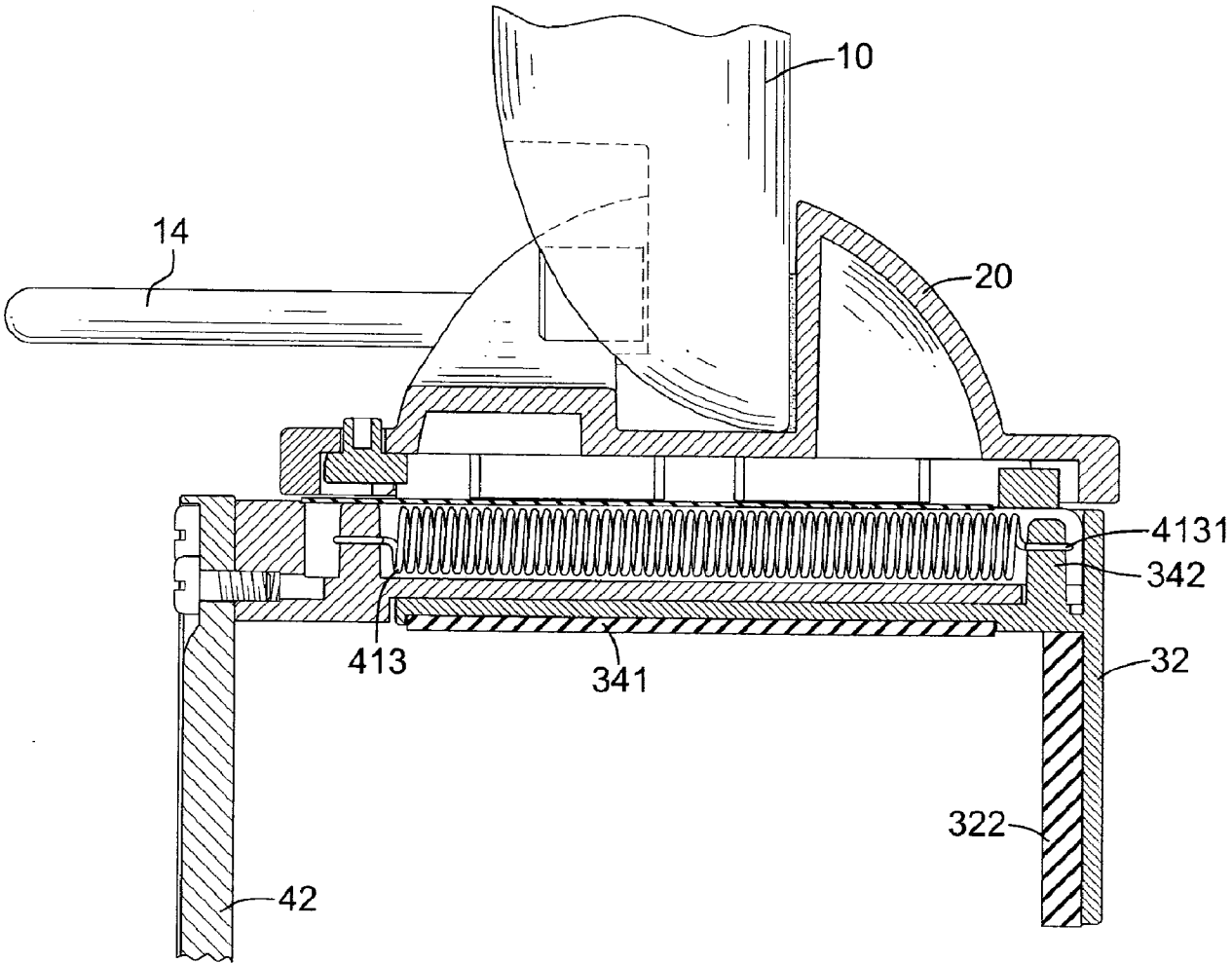
FIG. 5 is an enlarged light side view in partial section of the internal antenna with rotatable mounting bracket assembly in FIG. 1 with a clamp pulled into a mounting bracket.
Figure 6:
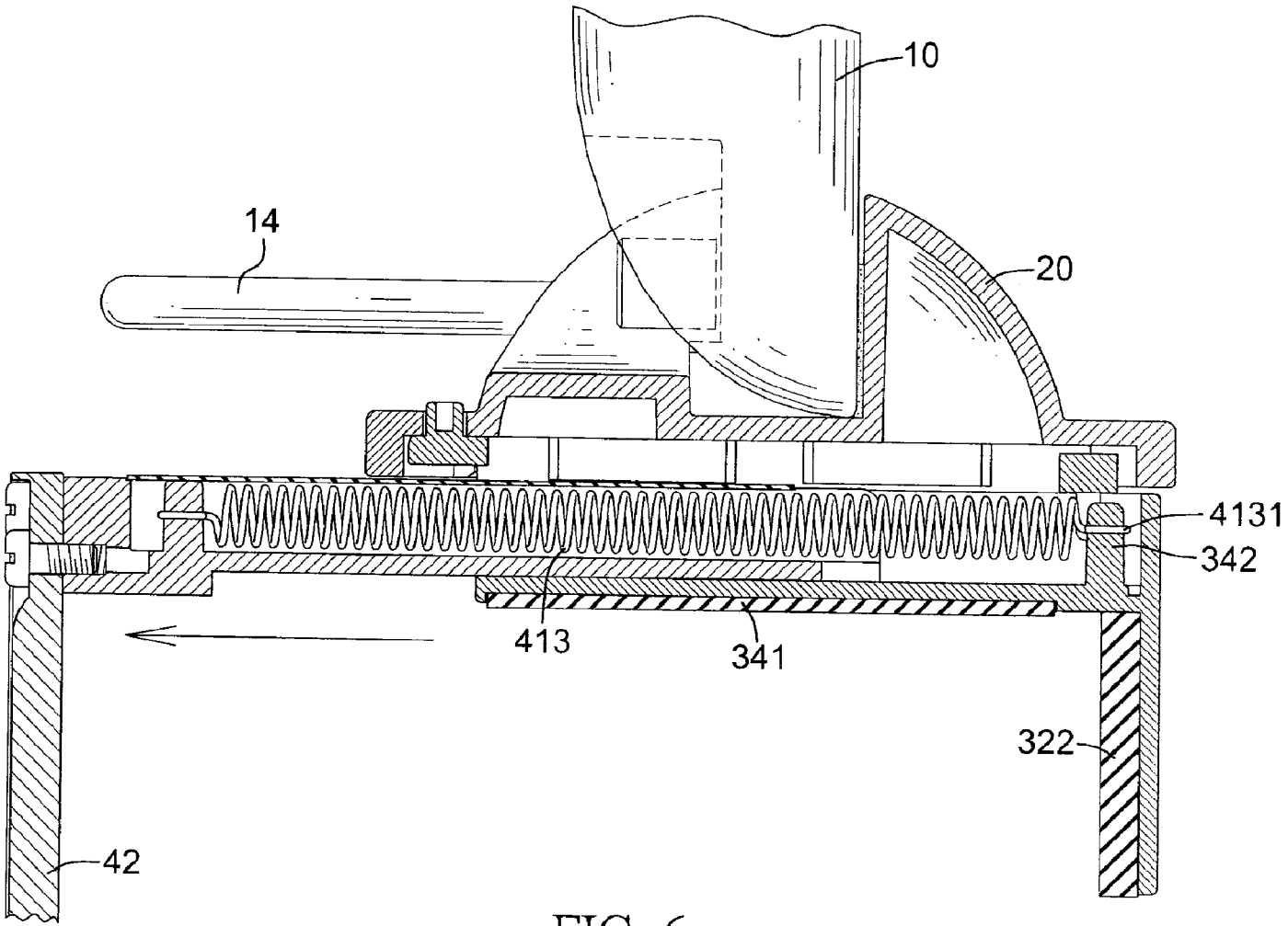
FIG. 6 is an operational right side view of the internal antenna with rotatable mounting bracket assembly in FIG. 5 with the clamp pulled out of the mounting bracket.
Figure 7:
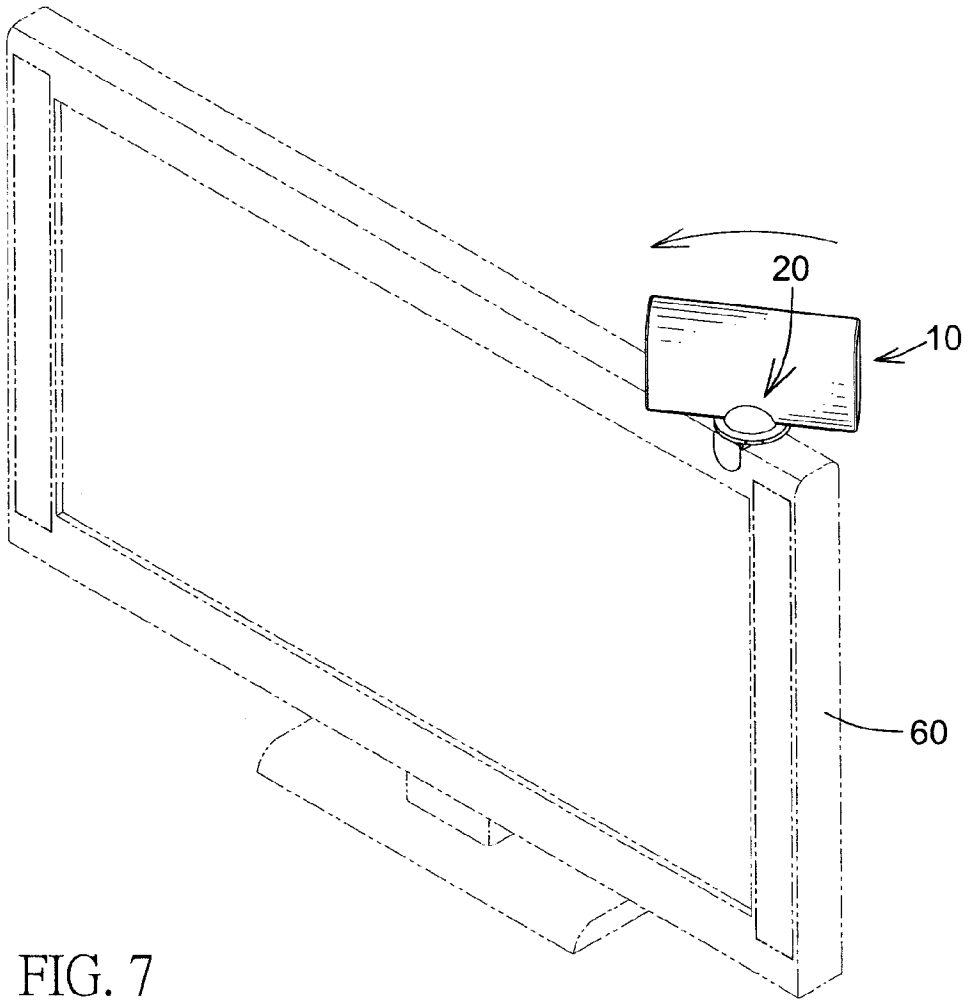
FIG. 7 is an operational perspective view of the internal antenna with rotatable mounting bracket assembly in FIG. 1 mounted on a flat panel television

With reference to FIGS. 5, 6, and 7, the advantage of the internal antenna with rotatable mounting bracket assembly is that a distance of the front jaw (32) and the rear jaw (42) can be adjusted to fit with flat panel televisions with difference thicknesses. Moreover, the internal antenna with rotatable mounting bracket assembly allows the antenna (10) to rotate up to 180°.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. An internal antenna with a rotatable mounting bracket assembly comprising a mounting bracket having a mounting disk having an upper surface;

a lower surface;

an outer edge;

an open slot being formed diametrically through the mounting disk and having a front end communicating with the outer edge;

a rear end; and two parallel edges;

a positive stop being formed on and protruding up from the upper surface and having a width;

at least one notch being formed in one of the parallel edges of the open slot; and a clamp stop being defined at the rear end of the open slot;

a front jaw being formed on and protruding down perpendicular from the lower surface of the mounting disk at the outer edge corresponding to the front end of the open slot and having a rear surface; and a non-slip coating covering the rear surface of the front jaw;

a clamp socket being formed on and protruding down from the lower surface of the mounting disk, being connected to the front jaw, corresponding to and communicating with the open slot and having an inner bottom surface;

two longitudinal edges;

a front end being connected to the rear surface of the front jaw;

a rear end;

two sidewalls;
a bottom surface;
at least one tab recess being corresponded to the at least one notch and being formed in one of the longitudinal edges;
a protective sheet being attached to the bottom surface of the clamp socket;
a post being formed on and protruding up from the inner bottom surface of the clamp socket near the front end;
at least one setscrew tab being mounted respectively in the at least one tab recess and each one having a hole;
at least one setscrew hole being formed through the two sidewalls of the clamp socket and each one of the at least one setscrew hole corresponding to the hole in one of the at least one setscrew tab; and
at least one setscrew, each setscrew being mounted rotatably through one of the at least one setscrew hole and adjustably through the hole in a corresponding one of the at least one setscrew tab and having
a shaft having a distal end; and
a head; and
a clamp attaching to and holding the mounting bracket and having
an arm assembly being straight, corresponding to and being mounted slidably in the clamp socket, protruding from the open end of the clamp socket and having
a proximal end;
a distal end;
two sidewalls;
a top surface;
multiple positioning holes being formed in a line through each sidewall of the arm assembly, and each positioning hole selectively holding the distal end of one of the at least one setscrew to hold the arm assembly and the clamp securely in place;
a longitudinal slot being formed longitudinally in the top surface of the arm assembly, forming an opening in the distal end of the arm assembly and having
a bottom surface; and
a post being formed on and protruding up from the bottom surface close to the proximal end of the arm assembly;
a resilient element pulling the arm assembly into the clamp socket and having
two ends; and
two rings being formed respectively on the ends of the resilient element and being attached respectively to the posts; and
a rear jaw being parallel to the front jaw of the mounting bracket and having
a proximal end being connected to and protruding down from the proximal end of the arm assembly; and
an inner surface; and
a rotatable antenna seat mounted rotatably on the upper surface of the mounting disk of the mounting bracket and having
a disk being mounted rotatably on the top surface of the mounting disk of the mounting bracket and having
an outer edge;
a top surface;
a bottom surface rotatably abutting the top surface of the mounting disk of the mounting bracket;
multiple limiting skirt segments being formed on and protruding down from the bottom surface at the outer edge; and
at least one hooking skirt segment being resilient, being formed on and protruding down from the bottom surface at the outer edge between the multiple limiting skirt segments, rotatably connecting the rotatable antenna seat to the mounting disk of the mounting bracket, and each one of the at least one hooking skirt segment having
a distal edge; and
a lip being formed on and protruding from the distal edge and slidably engaging the edge of the mounting disk of the mounting bracket;
an antenna bracket being formed on and protruding up from the top surface of the disk and having
a rear; and
a groove being formed transversely through the antenna bracket;
a curved slot being formed through the disk, being mounted on the positive stop on the mounting disk and having a width being smaller than the width of the positive stop; and
an antenna being mounted in the groove of the antenna bracket and having
a front surface; and
a rear surface having
a power socket being formed on the rear surface of the antenna; and
a signal socket being formed on the rear surface of the antenna.

2. The internal antenna with a rotatable mounting bracket assembly as claimed in claim 1, wherein the resilient element is a spring.

3. The internal antenna with a rotatable mounting bracket assembly as claimed in claim 1, wherein the antenna bracket is plastic.

4. The internal antenna with a rotatable mounting bracket assembly as claimed in claim 1, wherein the front jaw is a rectangular bar.

5. The internal antenna with a rotatable mounting bracket assembly as claimed in claim 1, wherein
the rear surface of the antenna further has two holes; and the antenna further has a wire guide being a U-shaped, being mounted on and protruding from the rear surface and having two ends being mounted respectively in the two holes.

6. The internal antenna with a rotatable mounting bracket assembly as claimed in claim 5, wherein
the rear surface of the antenna further has a recess corresponding to the groove of the antenna bracket;
the power socket is formed in the recess of the rear surface of the antenna; and
the signal socket is formed in the recess of the rear surface of the antenna.

7. The internal antenna with a rotatable mounting bracket assembly as claimed in claim 6, wherein the arm assembly further has
two retainer holes being formed in the top surface of the arm assembly near the distal end; and
a retainer being a bridge, being thicker than the clamp stop, being mounted on the top surface of the arm assembly near the distal end and having
a bottom surface; and
two mounting posts being formed on and protruding form the bottom surface of the retainer and corresponding respectively to and being plugged respectively into the retainer holes; and a cover being rectangular and corresponding to and covering the longitudinal slot.

8. The internal antenna with a rotatable mounting bracket assembly as claimed in claim 7, wherein the rear jaw has a protective pad being resilient and being attached to the inner surface of the rear jaw.

9. The internal antenna with a rotatable mounting bracket assembly as claimed in claim 8, wherein the front jaw further has a non-slip coating being attached to and covering the rear surface of the front jaw.

10. The internal antenna with a rotatable mounting bracket assembly as claimed in claim 9, wherein the clamp socket further has a protective sheet attached to the bottom surface of the clamp socket.

11. A rotatable mounting bracket assembly for an internal antenna comprising a mounting bracket having a mounting disk having an upper surface;

a lower surface;

an outer edge;

an open slot being formed diametrically through the mounting disk and having a front end communicating with the outer edge;

a rear end; and two parallel edges;

a positive stop being formed on and protruding up from the upper surface and having a width;

at least one notch being formed in one of the parallel edges of the open slot; and a clamp stop being defined at the rear end of the open slot;

a front jaw being formed on and protruding down perpendicular from the lower surface of the mounting disk at the outer edge corresponding to the front end of the open slot and having a rear surface; and a non-slip coating covering the rear surface of the front jaw;

a clamp socket being formed on and protruding down from the lower surface of the mounting disk, being connected to the front jaw, corresponding to and communicating with the open slot and having an inner bottom surface;

two longitudinal edges;

a front end being connected to the rear surface of the front jaw;

a rear end;

two sidewalls;

a bottom surface;

at least one tab recess being corresponded to the at least one notch and being formed in one of the longitudinal edges;

a protective sheet being attached to the bottom surface of the clamp socket;

a post being formed on and protruding up from the inner bottom surface of the clamp socket near the front end;

at least one setscrew tab being mounted respectively in the at least one tab recess and each one having a hole;

at least one setscrew hole being formed through the two sidewalls of the clamp socket and each one of the at least one setscrew hole corresponding to the hole in one of the at least one setscrew tab; and at least one setscrew, each setscrew being mounted rotatably through one of the at least one setscrew hole and adjustably through the hole in a corresponding one of the at least one setscrew tab and each having a shaft having a distal end; and a head; and a clamp attaching to and holding the mounting bracket and having an arm assembly being straight, corresponding to and being mounted slidably in the clamp socket, protruding from the open end of the clamp socket and having a proximal end;

a distal end;

two sidewalls;

a top surface;

multiple positioning holes being formed in a line through each sidewall of the arm assembly, and each positioning hole selectively holding the distal end of one of the at least one setscrew to hold the arm assembly and the clamp securely in place;

a longitudinal slot being formed longitudinally in the top surface of the arm assembly, forming an opening in the distal end of the arm assembly and having a bottom surface; and a post being formed on and protruding up from the bottom surface close to the proximal end of the arm assembly;

a resilient element pulling the arm assembly into the clamp socket and having two ends; and two rings being formed respectively on the ends of the resilient element and being attached respectively to the posts; and a rear jaw being parallel to the front jaw of the mounting bracket and having a proximal end being connected to and protruding down from the proximal end of the arm assembly; and an inner surface; and a rotatable antenna seat mounted rotatably on the upper surface of the mounting disk of the mounting bracket and having a disk being mounted rotatably on the top surface of the mounting disk of the mounting bracket and having an outer edge;

a top surface;

a bottom surface rotatably abutting the top surface of the mounting disk of the mounting bracket;

multiple limiting skirt segments being formed on and protruding down from the bottom surface at the outer edge; and at least one hooking skirt segment being resilient, being formed on and protruding down from the bottom surface at the outer edge between the multiple limiting skirt segments, rotatably connecting the rotatable antenna seat to the mounting disk of the mounting bracket, and each one of the at least one hooking skirt segment having a distal edge; and a lip being formed on and protruding from the distal edge and slidably engaging the edge of the mounting disk of the mounting bracket;

an antenna bracket being formed on and protruding up from the top surface of the disk and having a rear; and a groove being formed transversely through the antenna bracket; and a curved slot being formed through the disk, being mounted on the positive stop on the mounting disk and having a width being smaller than the width of the positive stop.

12. The rotatable mounting bracket assembly for an internal antenna as claimed in claim 11, wherein the resilient element is a spring.

13. The rotatable mounting bracket assembly for an internal antenna as claimed in claim 11, wherein the antenna bracket is plastic.

14. The rotatable mounting bracket assembly for an internal antenna as claimed in claim 11, wherein the front jaw is a rectangular bar.

15. The rotatable mounting bracket assembly for an internal antenna as claimed in claim 14, wherein the arm assembly further has two retainer holes being formed in the top surface of the arm assembly near the distal end; and a retainer being a bridge, being thicker than the clamp stop, being mounted on the top surface of the arm assembly near the distal end and having a bottom surface; and two mounting posts being formed on and protruding form the bottom surface of the retainer and corresponding respectively to and being plugged respectively into the retainer holes; and a cover being rectangular and corresponding to and covering the longitudinal slot.

16. The rotatable mounting bracket assembly for an internal antenna as claimed in claim 15, wherein the rear jaw has a protective pad being resilient and being attached to the inner surface of the rear jaw.

17. The rotatable mounting bracket assembly for an internal antenna as claimed in claim 16, wherein the front jaw further has a non-slip coating being attached to and covering the rear surface of the front jaw.

18. The rotatable mounting bracket assembly for an internal antenna as claimed in claim 17, wherein the clamp socket further has a protective sheet attached to the bottom surface of the clamp socket.

* * * * *